US009534383B1

(12) United States Patent
Underkofler et al.

(10) Patent No.: US 9,534,383 B1
(45) Date of Patent: Jan. 3, 2017

(54) CEILING PANEL SYSTEM

(71) Applicant: USG Interiors, LLC, Chicago, IL (US)

(72) Inventors: Abraham M. Underkofler, Kenosha, WI (US); Peder J. Gulbrandsen, Aurora, IL (US); Mark R. Paulsen, Waukegan, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 14/919,813

(22) Filed: Oct. 22, 2015

(51) Int. Cl.
*E04B 9/22* (2006.01)
*E04B 9/04* (2006.01)

(52) U.S. Cl.
CPC ..... *E04B 9/225* (2013.01); *E04B 9/0435* (2013.01)

(58) Field of Classification Search
CPC ..... E04B 9/225; E04B 9/0435; E04B 9/18; E04B 9/0478; E04B 9/006; E04B 2001/8442; E04B 2001/8423
USPC ..... 52/484, 489, 506.06–506.09
See application file for complete search history.

(56) References Cited

U.S. PATENT DOCUMENTS 1,738,469 A * 12/1929 Weiss ..... E04B 9/26 52/506.09
1,997,581 A * 4/1935 Heeren ..... E04B 9/26 248/228.7
1,997,595 A * 4/1935 Nold ..... E04B 9/26 52/506.09
2,101,349 A * 12/1937 Sharp ..... E06B 3/9682 160/381
2,486,563 A * 11/1949 Jorgensen ..... E04B 9/001 165/53
2,736,406 A * 2/1956 Johnson ..... E04B 9/0478 165/171
3,645,051 A * 2/1972 Kolesar ..... E04B 9/363 52/28
4,257,206 A * 3/1981 Mieyal ..... E04B 9/363 52/506.07
4,272,937 A * 6/1981 Brugman ..... E04B 9/363 52/506.07
4,438,613 A * 3/1984 Hintsa ..... E04B 9/003 49/465
4,548,010 A * 10/1985 Hintsa ..... E04B 9/003 52/506.09
4,549,375 A * 10/1985 Nassof ..... E04B 9/005 52/39

(Continued)

*Primary Examiner* — Brian Glessner
*Assistant Examiner* — Adam Barlow
(74) *Attorney, Agent, or Firm* — Pearne & Gordon LLP

(57) ABSTRACT

A panel assembly for a suspended ceiling comprising a sheet metal body and support brackets attached to the body, the sheet metal body having a rectangular generally planar face portion, a side portion along each of four edges of the face portion, the side portions extending upwardly from the face portion edges to side portion edges, and flanges extending inwardly from the side portion edges such that the flanges overlie and are spaced from the face portion, the side portions intersecting at corners of the panel assembly and the flanges being adjacent the corners, a hanger bracket associated with each corner abutting and fixed to the flanges adjacent each corner, the hanger bracket having at least one hole for attaching a suspension wire at a location spaced from said each corner a distance substantially greater than a width of the flanges adjacent said each corner.

11 Claims, 4 Drawing Sheets

(56) References Cited

U.S. PATENT DOCUMENTS

| | | | | | |
|---|---|---|---|---|---|
| 4,696,142 | A * | 9/1987 | Mieyal | E04B 9/26 | 52/506.08 |
| 4,901,485 | A * | 2/1990 | Menchetti | E04B 9/0428 | 181/291 |
| 5,050,360 | A * | 9/1991 | Gailey | E04B 9/0478 | 52/506.06 |
| 5,311,719 | A * | 5/1994 | Jahn | E04B 9/003 | 52/506.09 |
| 6,467,228 | B1 * | 10/2002 | Wendt | E04B 9/003 | 52/145 |
| 6,971,210 | B2 * | 12/2005 | Kliegle | E04B 9/003 | 52/489.1 |
| 8,291,667 | B2 * | 10/2012 | Jahn | E04B 9/28 | 52/483.1 |
| 8,572,920 | B2 * | 11/2013 | Bailey | E04B 9/0478 | 52/506.07 |
| 2007/0272816 | A1 * | 11/2007 | Friederich | E04B 9/006 | 248/343 |
| 2009/0000248 | A1 * | 1/2009 | Waters | E04B 9/0464 | 52/800.1 |
| 2013/0031863 | A1 * | 2/2013 | Jahn | E04B 9/28 | 52/506.07 |
| 2015/0240490 | A1 * | 8/2015 | Firinga | E04B 9/20 | 52/506.05 |

* cited by examiner

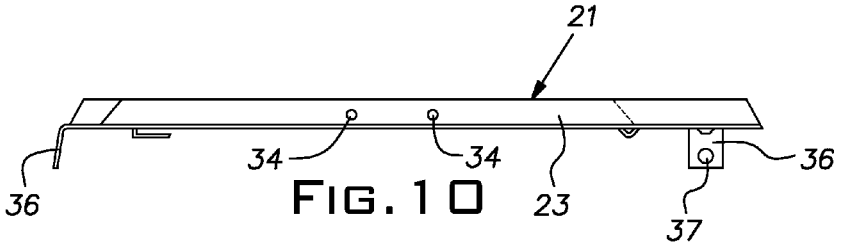
FIG. 10
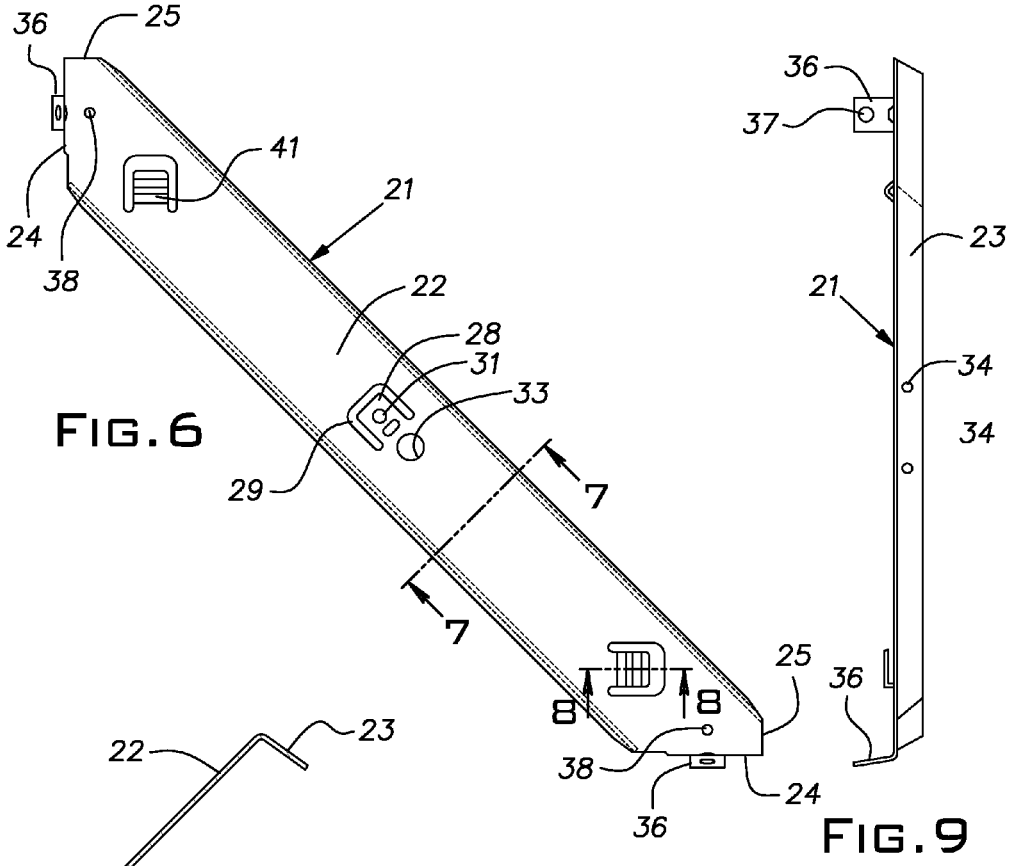
FIG. 6
FIG. 9
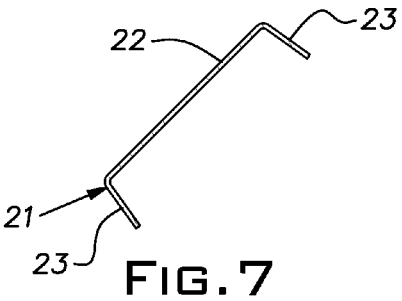
FIG. 7

CEILING PANEL SYSTEM

BACKGROUND OF THE INVENTION

The invention relates to suspended ceiling systems and, in particular, to individually suspended ceiling panels.

PRIOR ART

Various systems have been developed to construct a suspended ceiling. Most commonly, these ceilings comprise a rectangular grid on which are carried panels or tiles. Typically, these systems leave lower faces of the grid elements exposed. Less common, are systems in which faces of the grid elements are partially or wholly concealed.

Architects and interior designers have a continuous need to create new and distinguished ceiling treatments.

SUMMARY OF THE INVENTION

The invention provides a system of individually suspended ceiling panels. The inventive panels can be provided in a variety of rectangular shapes and sizes and can be readily used with any spacing and/or elevation. The system thereby offers the ceiling designer extensive freedom of design.

The panels, preferably fabricated of sheet metal, are characterized by a mounting structure that rigidifies the panels and offsets the suspension wires or cables from the panel edges to conceal or at least minimize their visibility. The mounting structure is provided as a metal bracket in the form of an inverted channel adjacent each panel corner. The disclosed hanger bracket affords several suspension options.

The disclosed hanger bracket is attached to reentrant flanges on the upper end of the panel sides thereby leaving the visible finish of the panel face and sides undisturbed. The hanger brackets distribute suspension forces from the weight of the panel along the sides of the panel to avoid distortion causing point loading on the panel. A bendable tab at each end of the hanger bracket is inserted in a receiving slot of a respective flange, folded over and fastened to ensure a reliable assembly with the panel.

The disclosed hanger bracket includes integral clips that can optionally be used to connect with horizontal stabilizer rods that bridge between adjacent panels to maintain the panels in a desired position.

BRIEF DESCRIPTION OF THE DRAWINGS

FIG. 6 is a plan view of a suspension bracket of the invention;

FIG. 7 is a cross-sectional view of the suspension bracket taken in the plane 7-7 indicated in FIG. 6;

FIG. 9 is a right view of the suspension bracket;

FIG. 10 is a front view of the suspension bracket;

DESCRIPTION OF THE PREFERRED EMBODIMENT

Figure 1:
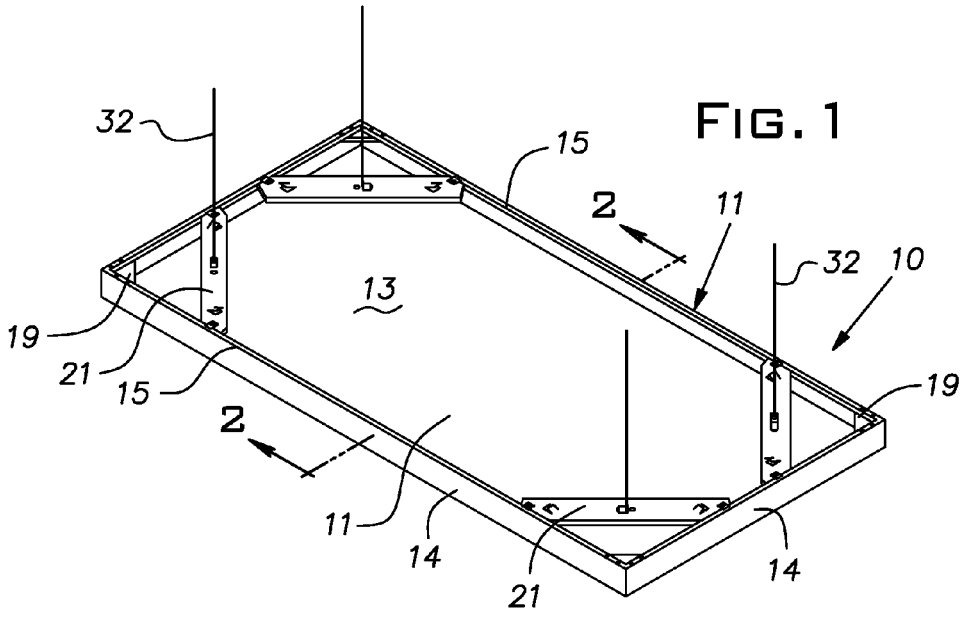
FIG. 1 is a perspective view from above of a typical ceiling panel constructed in accordance with the invention.
Figure 2:
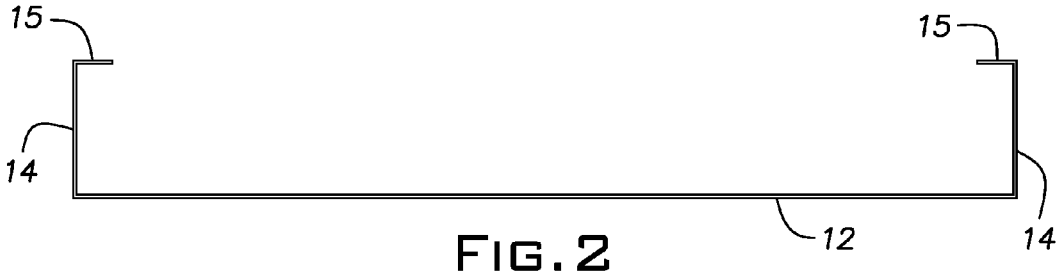
FIG. 2 is a cross-sectional view of the panel taken at the plane indicated at 2-2 in FIG. 1.

FIG. 1 illustrates a ceiling panel assembly 10 that can be used with other like panels for the construction of a suspended ceiling. The panel assembly 10 illustrated in FIG. 1 measures 2 foot by 4 foot in plan view and has its main body 11 formed of aluminum sheet of, for example, 0.040 inch gauge of 3003 or 3105 H14/H24. The main body 11 has a rectangular preferably planar face section 13 with vertical sides 14 at its perimeter. Upper edges of the sides are stiffened by horizontal inturned or reentrant flanges 15. The illustrated main body is fabricated from a single sheet so that the face section 13, sides 14, and flanges 15 are all integral.

By way of example but not limitation, the sides can be 1¾ inch wide and the flanges can be ½ inch wide; these dimensions can be varied as needed or desired. The panel flanges 15 are formed with slots 18 configured to receive parts of a support bracket described below.

Figure 11:
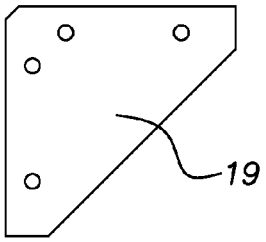
FIG. 11 is a plan view of a corner plate of a ceiling panel.
Figure 12:
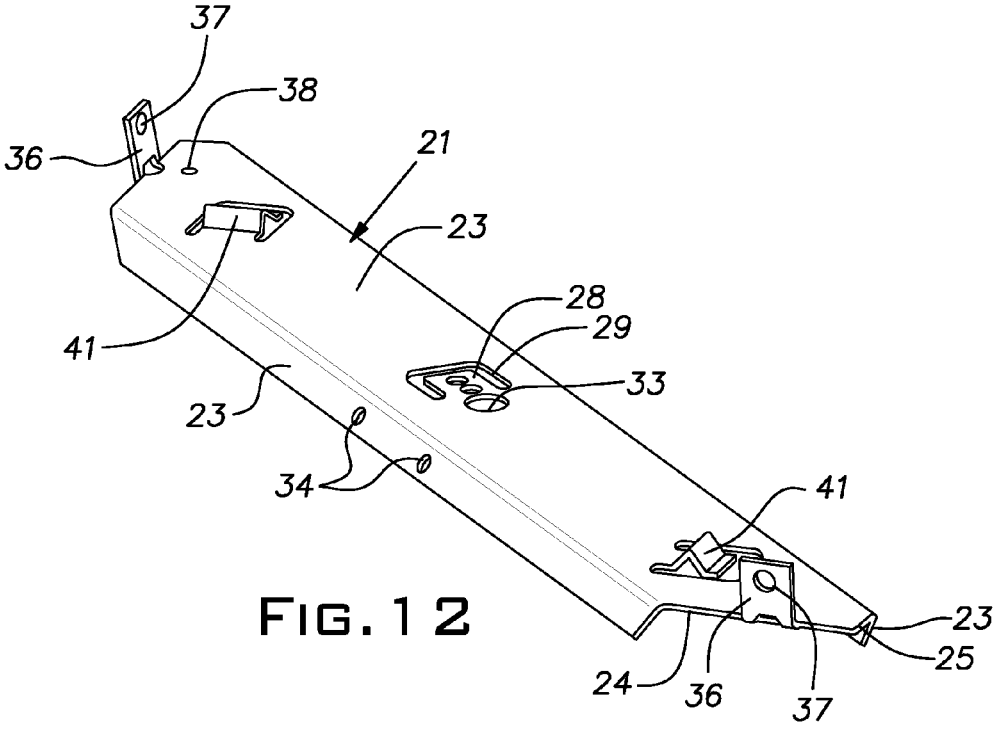
FIG. 12 is a perspective view of the suspension bracket in an as-manufactured state.

Each corner of the panel assembly 10 is reinforced by an identical triangular plate 19 shown in FIG. 11. The plate 19 can be made of the same material as the main body 11. The plate 19 is located below the flanges 15 and fixed thereto with rivets or like fasteners assembled in aligned holes in the plate and panel flanges.

An identical hanger bracket 21 is associated with each panel corner. Details of the bracket 21 are illustrated in FIGS. 6-10 and 12. The bracket 21 is stamped from a single piece of metal sheet stock such as 0.035 inch HDG (hot dipped galvanized) steel. The bracket 21 is an elongated unitary element having a cross-section of a channel with a central web 22 between a pair of flanges 23. In use, the bracket 21 is inverted such that the flanges 23 depend from the web 22. Major edges 24 and minor edges 25 are cut at angles of 45 degrees to the longitudinal direction of the bracket 21.

A suspension tab 28 is stamped in the bracket web 22 adjacent its center by cutting a U-shaped slot 29 in the web. The suspension tab 28 has a hole 31 for reception of a suspension wire 32 (seen in FIGS. 1 and 13). Adjacent the suspension tab 28 is a hole 33 for optionally receiving an end fitting for a suspension cable or other suspension element. Additional holes 34 are provided in the flanges 23 for optionally receiving suspension wire. Each major end edge 24 has an integral mounting tab 36 that when the bracket 21 is initially manufactured, projects upwardly, i.e. opposite of the flanges 23, from the plane of the web 22. A mounting tab 36 lies in a plane that is parallel to its respective major end edge 24. A hole 37 in the free end of the mounting tab 36 is alignable with a hole 38 in the web 22 when the tab is folded down towards the web. For purposes of stacking brackets 21 upon one another prior to assembly with the panel main body 11, the flanges 23 and tabs 36 can be oriented at an angle of 100 degrees, for example, relative to the plane of the web 22.

Figure 8:
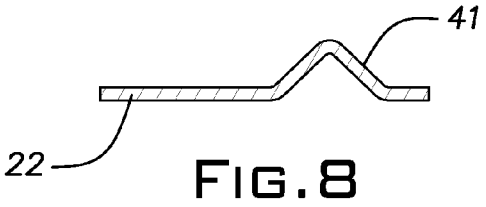
FIG. 8 is a fragmentary cross-sectional view of an integral clip formed on the suspension bracket taken at the plane 8-8 indicated in FIG. 6.

Adjacent each end of the bracket 21 is formed an integral clip 41 standing above the plane of the web 22. The clip 41, shown in section in FIG. 8, is configured to form a pocket to receive a rod extending at 45 degrees to the bracket and, as suggested below, perpendicular to an adjacent side of a panel 10.

A hanger bracket 21 is installed on the main body 11 by positioning the bracket in the interior of the panel, aligning the mounting tabs 36 with slots 18 in the panel flanges 15, moving the bracket 21 to extend both of its mounting tabs fully through the slots, and abutting the bracket with the underside of the respective flanges 15 and then folding or bending the tabs flat against the outer surface of the respective flanges. In this position of the mounting tabs 36, the holes 37 in the tab and the holes 38 in the web are aligned and a fastener such as a rivet or screw is assembled and tightened against the tab and flange. Each panel corner has a respective hanger bracket 21 associated with it.

The flanges 15 represent the backside of the panel assembly 10. The side of the planar section 12 opposite to that shown in FIG. 1 faces a room or occupied space and constitutes the visible face of the panel assembly.

Figure 13:
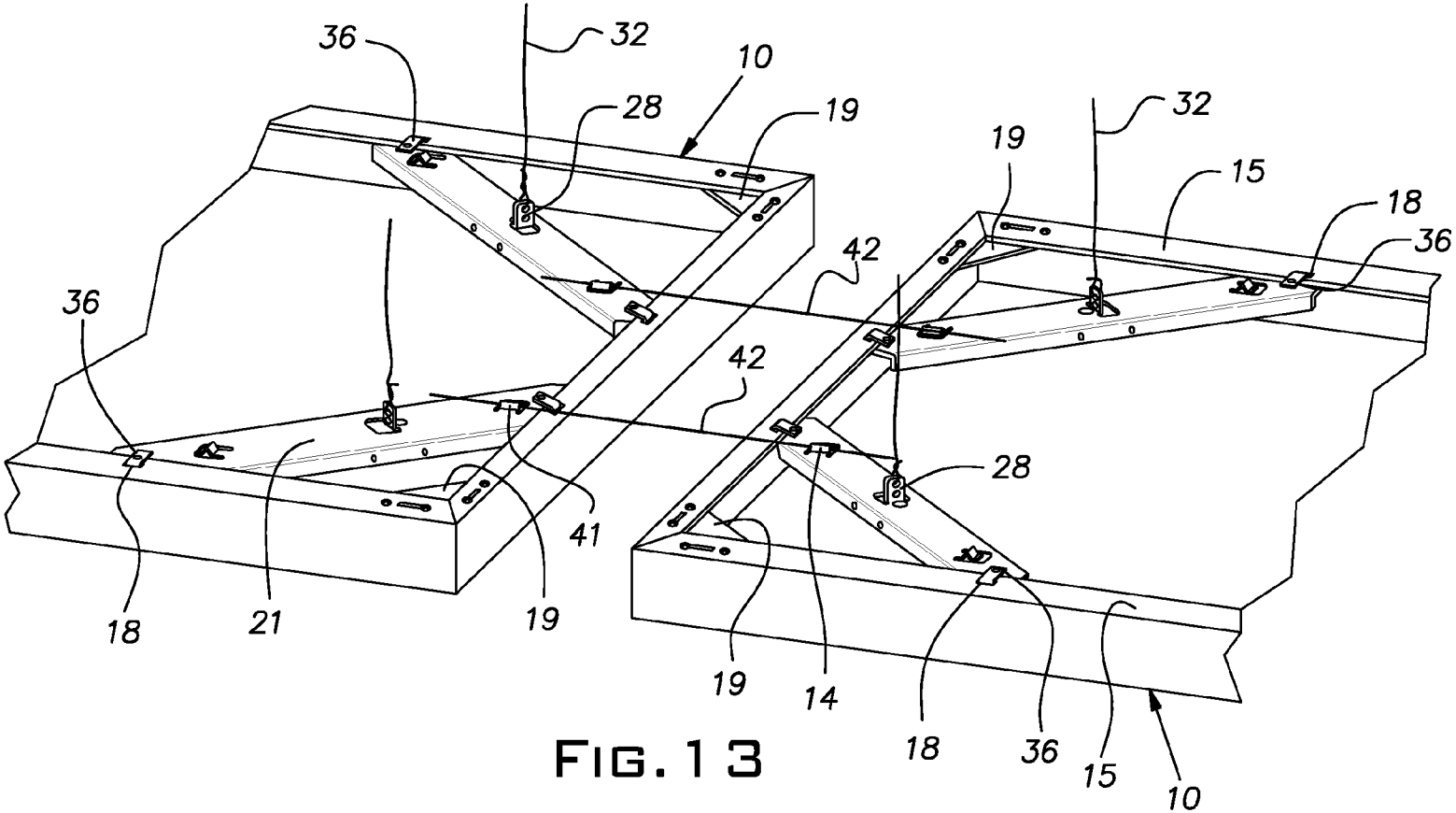
FIG. 13 is a fragmentary perspective view of a pair of ceiling panels in relative position stabilized by rods bridging between the panels.

A panel assembly 10 is normally suspended with suspension wires, one on each hanger bracket 21, which can be, for example, the standard 12 gauge wire used in the conventional suspended ceiling construction to suspend the grid runners or tees. In the illustration of FIG. 13, suspension wires 32 are looped through the suspension tab holes 31 and twisted on themselves to lock them in place. The suspension tabs 28 are normally deployed by the installer bending them upwardly from the plane of the bracket web 22 at the site where the panel assemblies 10 are being installed. Alternatively, to reduce visibility of the wire at each bracket 21, a wire can be threaded through a hole or holes 34 in the bracket flanges 23. Another variant is the use of the central hole 33 for receiving the end fitting on a suspension cable. Ordinarily numerous panel assemblies 10 will be used to construct a ceiling.

Typically, the panel assemblies 10 will be horizontally spaced from one another a distance specified by the ceiling designer. The panel assemblies 10 can be held at a desired relative distance by positioning rods or wires in the clips 41. The clips 41 are proportioned to provide a tight friction fit for conventional 12 gauge suspension wires. As shown in FIG. 13, the panel assemblies 10 can be aligned with one another and lengths of wire 42 can be assembled in opposing clips 41 of adjacent panel assemblies. The wire lengths can be cut to suit the specific installation. It will be seen that the spacing wire or rods 42 intersect the brackets at 45 degree angles corresponding to the orientation of the clips 41 and are perpendicular to the adjacent panel sides 14. The wires 42 can be painted black or the color of the superstructure above the panel assemblies 10 to make them less noticeable.

Figure 3:
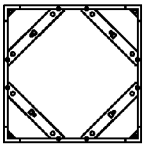
FIG. 3 is a somewhat schematic plan view of a two foot by two foot ceiling panel.
Figure 4:
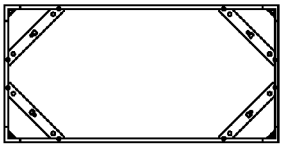
FIG. 4 is a somewhat schematic plan view of a two foot by four foot ceiling panel.
Figure 5:
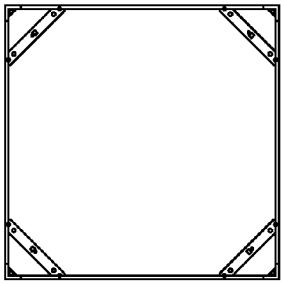
FIG. 5 is a somewhat schematic plan view of a four foot by four foot ceiling panel.

FIGS. 3-5 illustrate panels of different face sizes, i.e. 2 foot by 2 foot, 2 foot by 4 foot, and 4 foot by 4 foot, respectively. Various other sizes such as 2 foot by 6 foot, 2½ foot by 2½ foot, 2½ foot by 5 foot and 4 foot by 5 foot are contemplated. Industry metric equivalents of the dimensions given in this description can be used. Square face panels are included in the term rectangular. The described corner plate 19 and hanger bracket 21 can be used with all of these panel sizes. The visible face of the panel assembly 10 can be painted, powder coated or anodized, for example. Additionally, the panel face can be perforated with a regular pattern of holes or with holes defining an image. The interior of the perforated panels can be illuminated so that the perforations glow. Also, the interior of the panels can be provided with sound absorbing material as needed.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A panel assembly for a suspended ceiling comprising a sheet metal body and support brackets attached to the body, the sheet metal body having a rectangular generally planar face portion, a side portion along each of four edges of the face portion, the side portions extending upwardly from the face portion edges to side portion edges, and flanges extending inwardly from the side portion edges such that the flanges overlie and are spaced from the face portion, the side portions intersecting at corners of the panel assembly and the flanges being adjacent the corners, a hanger bracket associated with each corner, the hanger bracket being an elongated sheet metal element having a cross section with a generally horizontal web and portions integral with the web oriented at angles to the web, ends of the hanger bracket being fixed to the flanges at locations spaced a distance from the associated corner, the hanger bracket having at least one hole for attaching a suspension wire for the associated corner the hole being at a location spaced from adjacent flanges at said associated corner a distance substantially greater than a width of the adjacent flanges, whereby when viewed by a person below and off to a side, the suspension wire is obscured by the sheet metal body.

2. A panel assembly for a suspended ceiling comprising a sheet metal body and support brackets attached to the body, the sheet metal body having a rectangular generally planar face portion, a side portion along each of four edges of the face portion, the side portions extending upwardly from the face portion edges to side portion edges, and flanges extending inwardly from the side portion edges such that the flanges overlie and are spaced from the face portion, the side portions intersecting at corners of the panel assembly and the flanges being adjacent the corners, a hanger bracket associated with each corner abutting and fixed to the flanges adjacent each corner, the hanger bracket having at least one hole for attaching a suspension wire at a location spaced from said each corner a distance substantially greater than a width of the flanges adjacent said each corner, the hanger bracket being an elongated sheet metal inverted channel having depending flanges and an intermediate web.

3. A panel assembly as set forth in claim 2, wherein the hanger bracket web has end edges lying in planes forming an acute angle to a longitudinal direction of the hanger bracket.

4. A panel assembly as set forth in claim 2, wherein the hanger bracket flanges have holes at a mid-length.

5. A panel assembly as set forth in claim 3, wherein said end edges lie below the panel flanges.

6. A panel assembly as set forth in claim 1, wherein the hanger bracket includes mounting tabs extending through slots in the panel flanges.

7. A panel assembly as set forth in claim 6, wherein the hanger bracket mounting tabs are folded back on the panel flanges.

8. A panel assembly as set forth in claim 7, wherein the hanger bracket tabs are secured to the panel flanges with fasteners extending through the hanger bracket mounting tabs and the panel flanges.

9. A panel assembly as set forth in claim 1, wherein the hanger bracket includes integral clips forming pockets configured to receive and confine a straight stabilizing rod in a plane parallel to the face of the panel body and perpendicular to an associated edge of the panel body.

10. A panel assembly as set forth in claim 9, wherein the clip is constructed and arranged to provide a friction fit on a 12 gauge wire.

11. A panel assembly as set forth in claim 1, including a gusset plate attached to the underside of a pair of panel body flanges at each corner of the panel body and spaced from an associated hanger bracket.

* * * * *